US008998010B1

(12) United States Patent
Kennedy

(10) Patent No.: US 8,998,010 B1
(45) Date of Patent: Apr. 7, 2015

(54) TIERED ORGANIZER AND DISPLAY RACK

(71) Applicant: Lois E. Kennedy, San Francisco, CA (US)

(72) Inventor: Lois E. Kennedy, San Francisco, CA (US)

( * ) Notice: Subject to any disclaimer, the term of this patent is extended or adjusted under 35 U.S.C. 154(b) by 87 days.

(21) Appl. No.: 13/864,348

(22) Filed: Apr. 17, 2013

Related U.S. Application Data

(60) Provisional application No. 61/636,150, filed on Apr. 20, 2012, provisional application No. 61/699,262, filed on Sep. 10, 2012.

(51) Int. Cl.
*A47F 5/08* (2006.01)
*A47F 7/00* (2006.01)
*A47F 7/02* (2006.01)
(Continued)

(52) U.S. Cl.
CPC ..... *A47B 55/00* (2013.01); *A47F 5/0876* (2013.01); *A47F 5/02* (2013.01); *A47F 5/0892* (2013.01); *A47F 7/12* (2013.01); *A47F 7/02* (2013.01); *D06F 57/125* (2013.01); *A47B 43/006* (2013.01); *A47B 61/003* (2013.01);
(Continued)

(58) Field of Classification Search
CPC ..... A47F 5/0892; A47F 5/0876; A47F 5/08; A47F 5/0807; A47F 3/08; A47F 5/0006; A47F 7/12; A47F 7/16; A47F 5/02; A47F 7/08; A47F 5/025; A47F 7/02; A47F 7/022; A47F 7/19; A47F 7/24; A47B 61/00; A47B 61/003; A47B 49/00; A47B 61/04; A47B 43/003; A47B 96/1425; A47B 43/006; A47B 81/00; A47B 55/00; A47B 55/02; A47G 25/746; A47G 25/743; A47G 25/0664; A47G 7/041; A47G 7/047; A47G 25/06; A47G 25/0607; A47G 25/0614; A47G 25/40; A47G 25/54; A47G 25/0692; D06F 57/125; D06F 57/12
USPC ..... 211/113, 115, 117, 118, 119, 119.004, 211/119.009, 85.3, 106, 95, 58, 48, 163, 211/165, 106.01; 248/317
See application file for complete search history.

(56) References Cited

U.S. PATENT DOCUMENTS 644,728 A * 3/1900 Biester ..... 211/117
889,517 A * 6/1908 Gerken ..... 108/23
(Continued)

OTHER PUBLICATIONS

Fox Run 3 Tier Hanging Fruit Vegetable Kitchen Storage Basket.
(Continued)

*Primary Examiner* — Jennifer E Novosad
(74) *Attorney, Agent, or Firm* — Duane S. Kobayashi

(57) ABSTRACT

A tiered rotary organizer and display rack. In one embodiment, an organizer rack is provided that includes an upper perimeter support and a lower perimeter support. A plurality of vertical partitions having an upper end and a lower end can be attached to the upper perimeter support near the upper end and attached to the lower perimeter support near the lower end, wherein each of the plurality of vertical partitions supports an article support member that is configured to support an item on the organizer rack. A plurality of upper rack support members are attached to the upper perimeter support, each of the plurality of upper rack support members being configured for attachment to one of a first plurality of elongated hanging supports (e.g., chain, rod, wire, etc.), wherein the coupling of the first plurality of elongated hanging supports to the plurality of upper rack support members is configured to provide a first hanging support of the organizer rack from an above support member (e.g., swivel socket or another organizer rack).

11 Claims, 8 Drawing Sheets

(51) Int. Cl.

| | |
|---|---|
| ***A47G 29/00*** | (2006.01) |
| ***A47G 29/087*** | (2006.01) |
| ***A47B 55/00*** | (2006.01) |
| ***A47F 5/02*** | (2006.01) |
| ***A47F 7/12*** | (2006.01) |
| ***D06F 57/12*** | (2006.01) |
| ***A47B 43/00*** | (2006.01) |
| ***A47B 61/00*** | (2006.01) |
| ***A47G 25/06*** | (2006.01) |
| ***A47G 25/74*** | (2006.01) |

(52) U.S. Cl.
CPC ..... *A47G25/0621* (2013.01); *A47G 25/0614* (2013.01); *A47G 25/746* (2013.01)

(56) References Cited

U.S. PATENT DOCUMENTS

| | | | | | |
|---|---|---|---|---|---|
| 1,078,729 | A | * | 11/1913 | Hill | 312/4 |
| 1,344,027 | A | * | 6/1920 | Evilsizor et al. | 211/119 |
| D77,225 | S | * | 12/1928 | Danz | D6/514 |
| 2,046,896 | A | | 7/1936 | Hedge | |
| 3,382,819 | A | * | 5/1968 | Davidson et al. | 108/23 |
| 3,998,334 | A | | 12/1976 | Smith | |
| 4,121,720 | A | * | 10/1978 | Hayes | 211/113 |
| D276,322 | S | * | 11/1984 | Maxwell et al. | D11/118 |
| 4,561,547 | A | * | 12/1985 | Estwanik, III | 211/14 |
| 4,858,772 | A | | 8/1989 | Phillipson | |
| D325,887 | S | * | 5/1992 | Vodhanel, Jr. | D11/118 |
| 5,458,249 | A | * | 10/1995 | Shang-Lu | 211/197 |
| 5,462,178 | A | | 10/1995 | Wallach et al. | |
| D392,133 | S | * | 3/1998 | Chen | D6/513 |
| D392,163 | S | * | 3/1998 | Jenkinson | D7/704 |
| 5,765,700 | A | * | 6/1998 | Donne | 211/85.31 |
| 5,833,080 | A | * | 11/1998 | Donne | 211/85.31 |
| 6,230,440 | B1 | | 5/2001 | Deutsch | |
| 6,273,277 | B1 | * | 8/2001 | Geldenhuys | 211/70 |
| 7,340,859 | B2 | * | 3/2008 | Palsrok | 47/39 |
| 7,398,888 | B1 | * | 7/2008 | Nowak | 211/59.2 |
| 8,567,617 | B1 | * | 10/2013 | Tapager | 211/74 |
| 2002/0190016 | A1 | | 12/2002 | Ta | |
| 2006/0037925 | A1 | * | 2/2006 | Wood et al. | 211/195 |
| 2009/0272017 | A1 | | 11/2009 | Wang | |
| 2009/0278010 | A1 | | 11/2009 | Cotter et al. | |

OTHER PUBLICATIONS

Honey-Can-Do 8-Shelf Hanging Organizer.
Rotating Belt, Tie & Scarf Rack.

* cited by examiner

TIERED ORGANIZER AND DISPLAY RACK

This application claims priority to provisional application No. 61/636,150, filed Apr. 20, 2012, and provisional application No. 61/699,262, filed Sep. 10, 2012. Each of the above-identified applications is incorporated by reference herein, in its entirety, for all purposes.

BACKGROUND

1. Field of the Invention

The present invention relates generally to organizers, and more particularly, to a tiered organizer and display rack.

2. Introduction

Organization is a key focus in many personal and business contexts. Organization can take various forms and can be focused on a way to maximize a use of available space.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Figure 1:
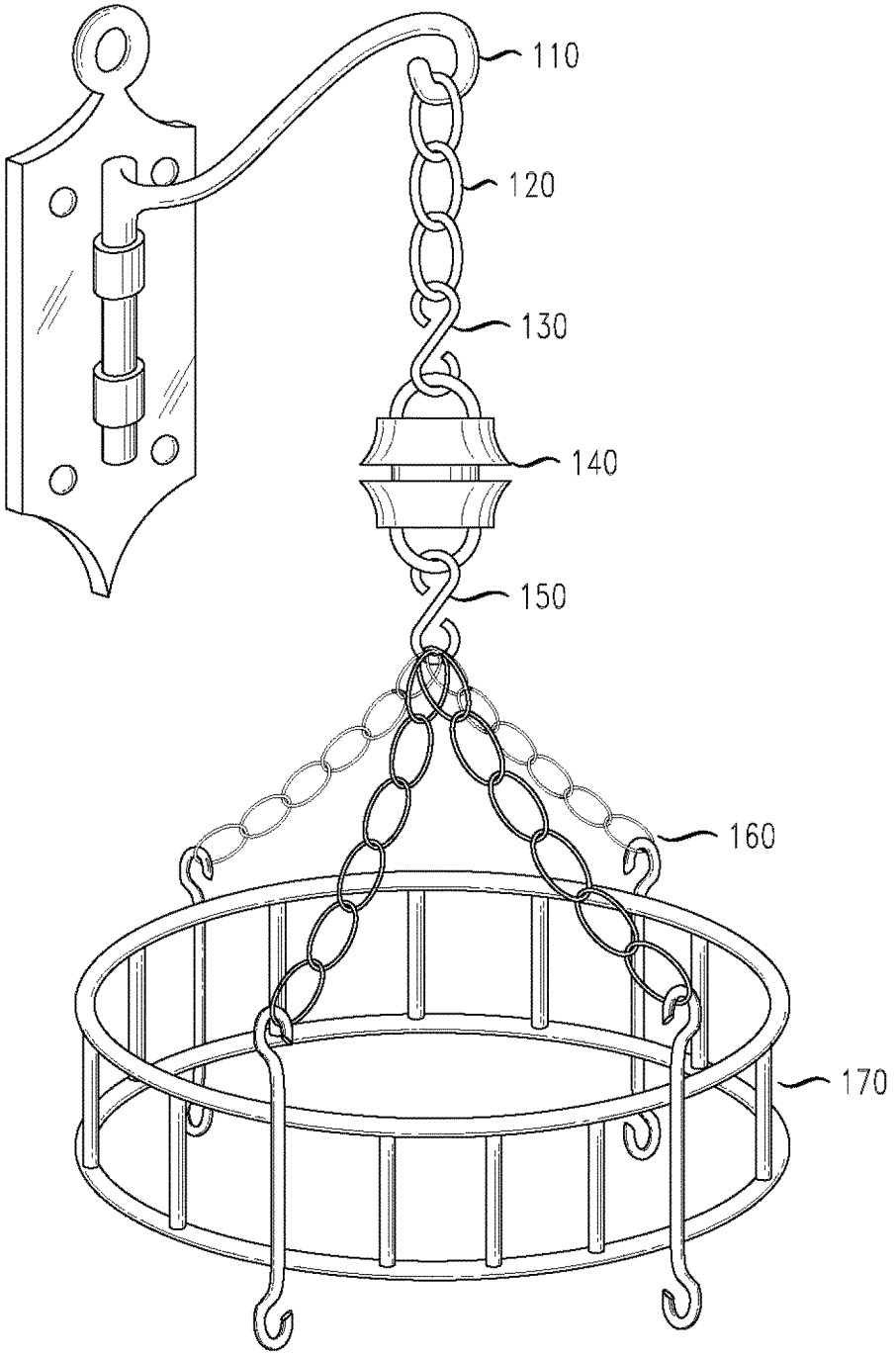
FIG. 1 illustrates an embodiment of a rotary organizer and display rack.

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

A tiered, adjustable, and revolving organizer rack is provided that is useful for the display and storage of various articles, including by way of example, belts, scarves, ties, jewelry, etc. In one embodiment, the organizer rack is round in shape and can be hung from the ceiling or other overhead support structure, a bracket mounted to a wall, etc. While the description below is focused on organizer racks that are round in shape, such an example is not intended to be limiting. In general, any organizer-rack shape that can enable a tiered structure as described below can be used. Moreover, individual tiers in a multi-tiered organizer rack can have the same shape or different shapes.

The organizer rack can be used in various environments to facilitate storage, display or other uses. For example, the organizer rack can be used for storage in residential environments (e.g., closets, garages, etc.), can be used in retail settings for display in a sales environment, can be used in commercial or other organizational environments to facilitate promotional or other informational material or products, etc. As would be appreciated, the flexibility of the organizer rack would facilitate many types of uses through its configurability. In one embodiment, the organizer rack can be supported by a variety of sizes and styles that can enable a user to customize their own system to accommodate a particular set of space and storage requirements. In general, one or more tiers of an organizer rack can be used to organizer or display various items that can be supported (e.g., hung, stored, enclosed, etc.) by the one or more tiers of the rack.

In one embodiment, an organizer rack is provided that includes an upper perimeter support and a lower perimeter support. A plurality of vertical partitions having an upper end and a lower end can be attached to the upper perimeter support near the upper end and attached to the lower perimeter support near the lower end, wherein each of the plurality of vertical partitions supports an article support member that is configured to support an item on the organizer rack. A plurality of upper rack support members are attached to the upper perimeter support, each of the plurality of upper rack support members being configured for attachment to one of a first plurality of elongated hanging supports (e.g., chain, rod, wire, etc.), wherein the coupling of the first plurality of elongated hanging supports to the plurality of upper rack support members is configured to provide a first hanging support of the organizer rack from an above support member (e.g., swivel socket or another organizer rack). A plurality of lower rack support members are also attached to the lower perimeter support. Each of the plurality of lower rack support members is configured for attachment to one of a second plurality of elongated hanging supports that are distinct from the first plurality of elongated hanging supports, wherein the coupling of the second plurality of elongated hanging supports to the plurality of lower rack support members is configured to provide a second hanging support to a second organizer rack tier that is hung below the lower perimeter support member.

FIG. 1 illustrates an embodiment of a rotary organizer and display rack. In one embodiment, the tiered, adjustable, and revolving rack can include the following component parts: hanging hardware such as a bracket 110, chain 120 and S-hook 130 for attaching the first tier of the organizer rack; a swivel socket 140, usable for larger set ups, and can include one or more S-hooks 130; one or more tiers 170 that can be embodied in various sizes and styles, wherein each tier can include a plurality of chains 150 for attachment to supporting S-hook 130 (or other tiers); and accessory hooks that can attach to the rack to facilitate support of one or more items to be stored or displayed.

Figure 2:
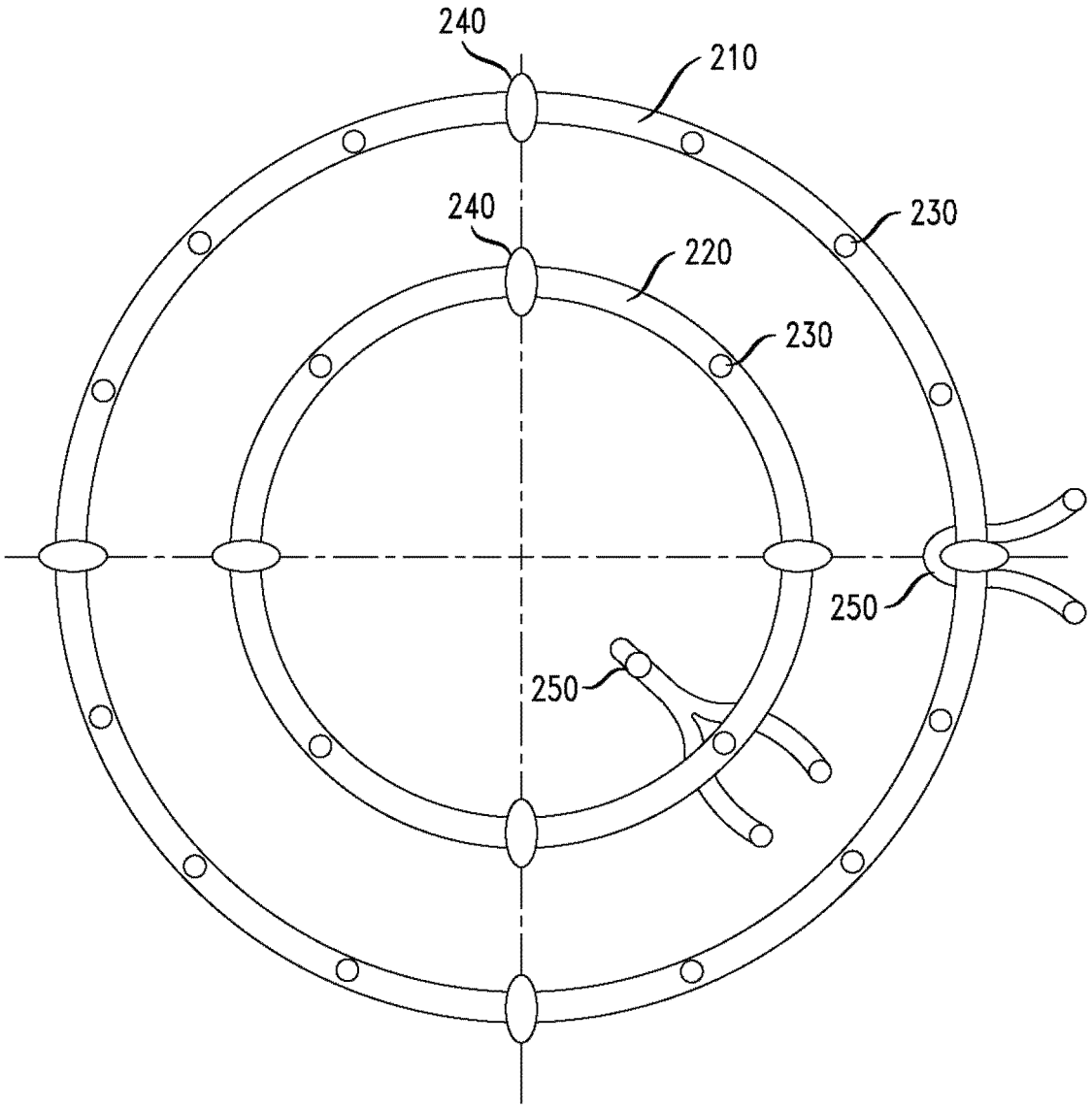
FIG. 2 illustrates a top view of an embodiment of multiple tiers in a tiered rotary organizer and display rack.

FIG. 2 illustrates a top view of an embodiment of multiple tiers in a tiered rotary organizer and display rack. As illustrated, multiple tiers 210, 220 of different sizes can include vertical partitions 230 and hooks 240 for hanging. The carousels can also support add-on hooks 250.

Figure 3A:
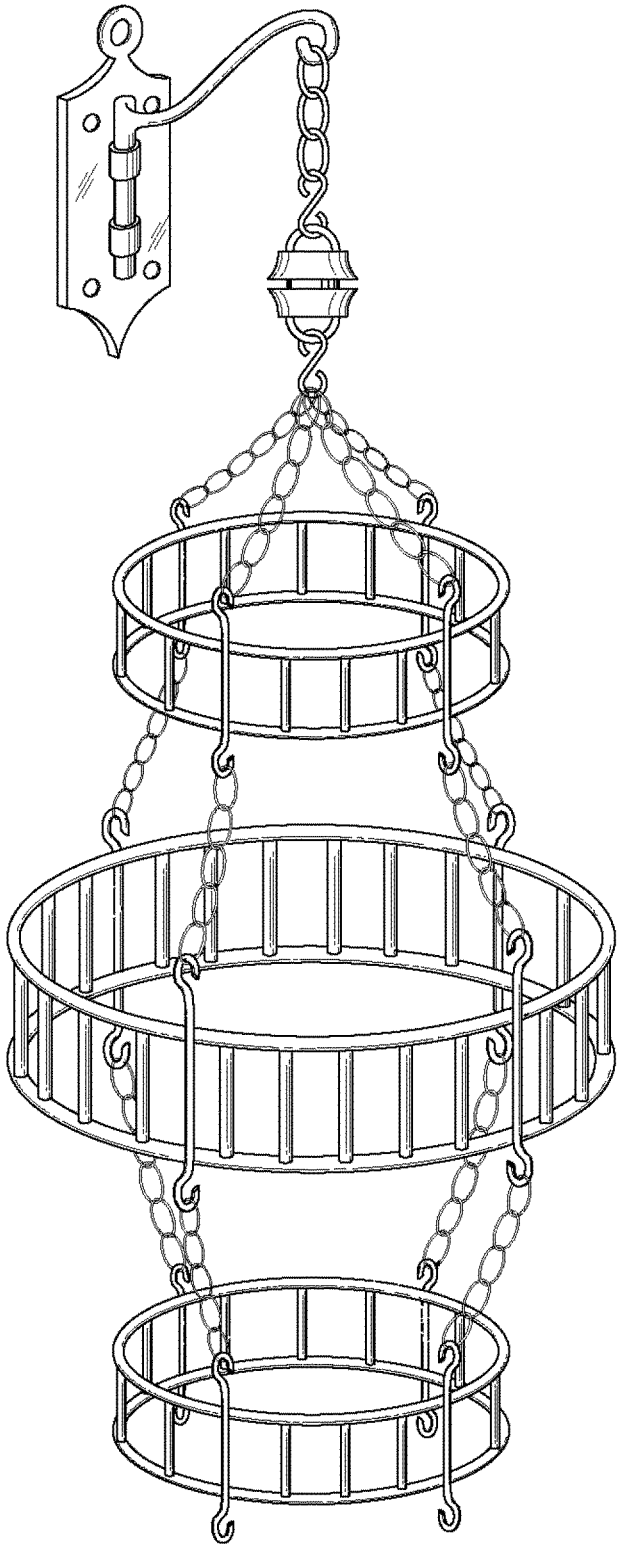
FIGS. 3A and 3B illustrate multiple tiers of a rotary organizer and display rack.
Figure 3B:
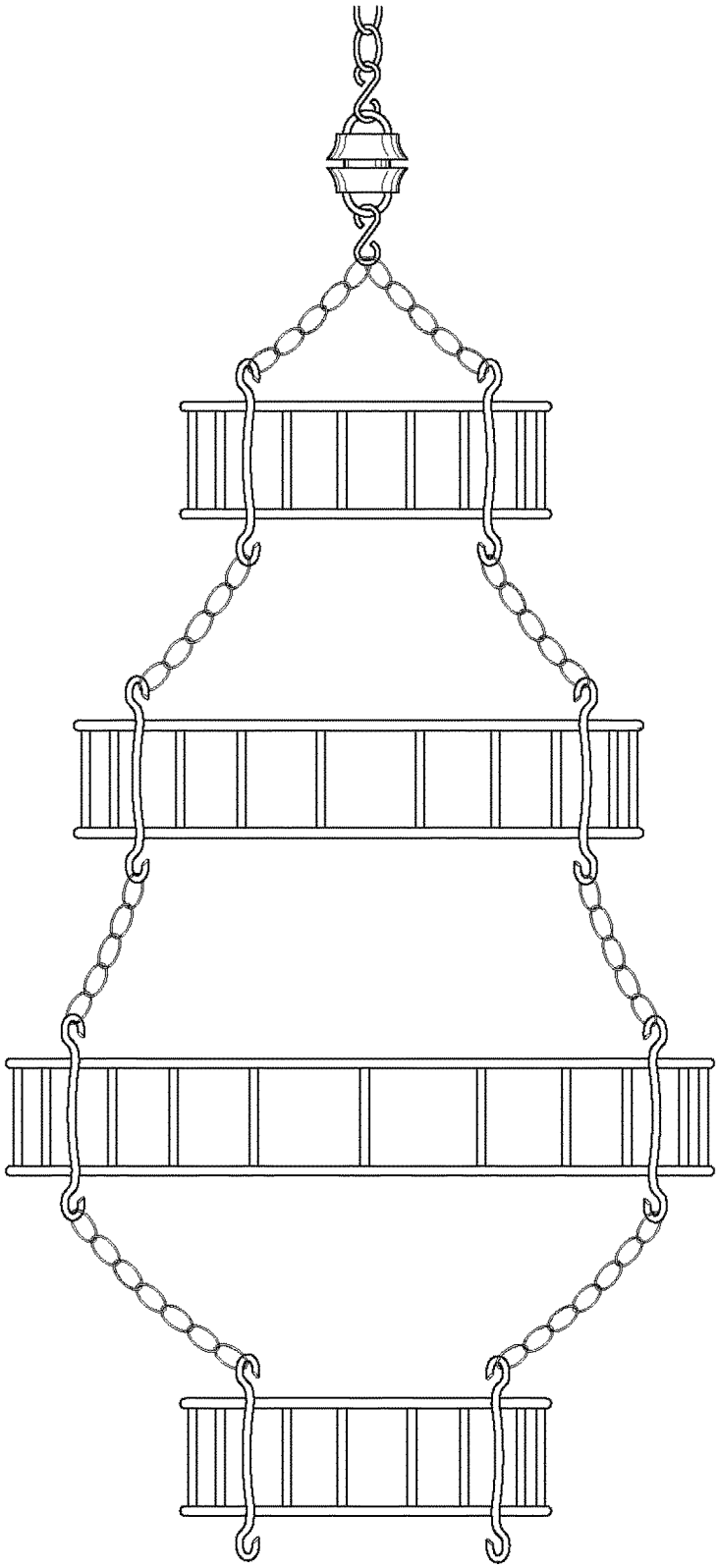

FIGS. 3A and 3B illustrate multiple tiers of a rotary organizer and display rack. FIG. 3A illustrates a three-tier rotary organizer and display rack, while FIG. 3B illustrates a four-tier rotary organizer and display rack. As would be appreciated, the number of tiers in the organizer and display rack as well as the sizes of individual tiers in the organizer and display rack can be chosen to suit a particular application. Further configurability can be enabled by add-on hooks that can be attached to one or more tiers of the organizer and display rack.

Figure 4C:
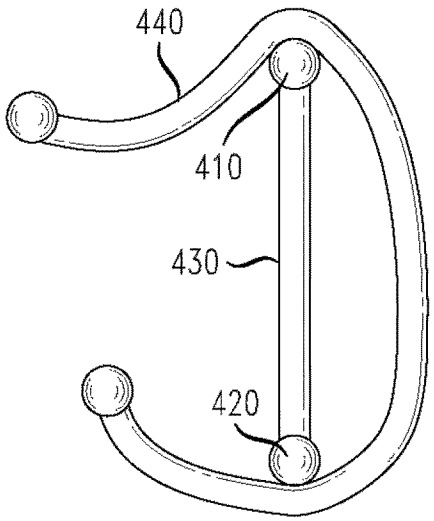
FIGS. 4A-4C illustrate embodiments of add-on hooks.
Figure 4B:
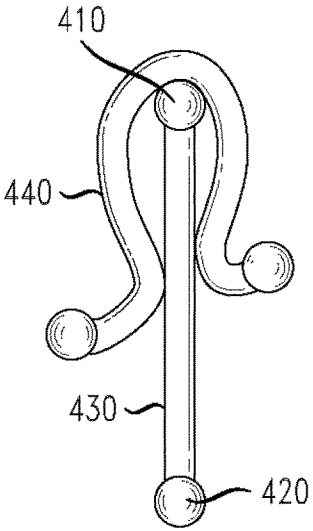
Figure 4A:
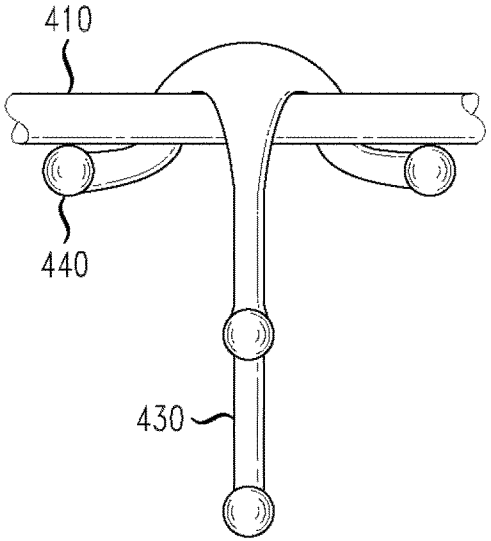

FIGS. 4A-4C illustrates add-on hooks 440 that can be attached to one or more tiers of an organizer and display rack. In the illustrated embodiments, add-on hooks 440 can be attached to a tier of an organizer and display rack at one or more of an upper perimeter support 410, a lower perimeter support 420 and/or vertical partition 430. As would be appreciated, the particular point of attachment of an add-on hook or other add-on support to an organizer and display rack can vary. In general, one or more add-on supports can be configured to be attached to a single tier or multiple tiers to facilitate support of one or more items.

Figure 5:
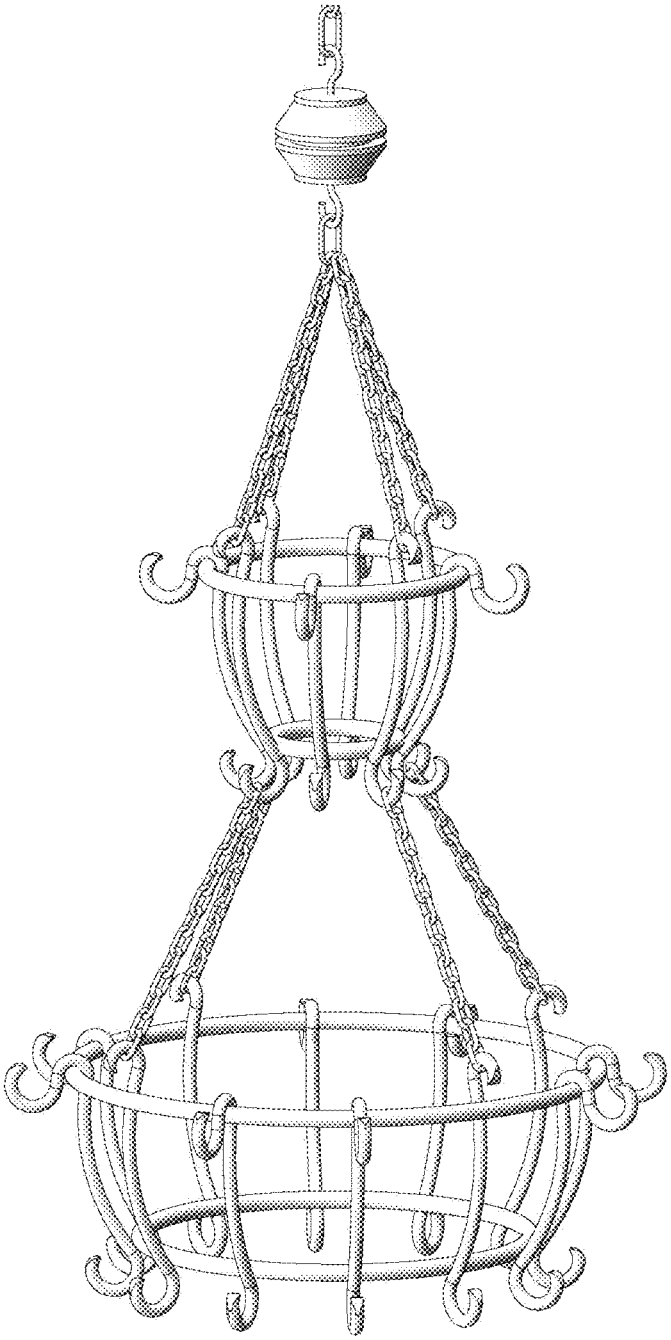
FIG. 5 illustrates an embodiment of a two-tiered rotary organizer and display rack.
Figure 6:
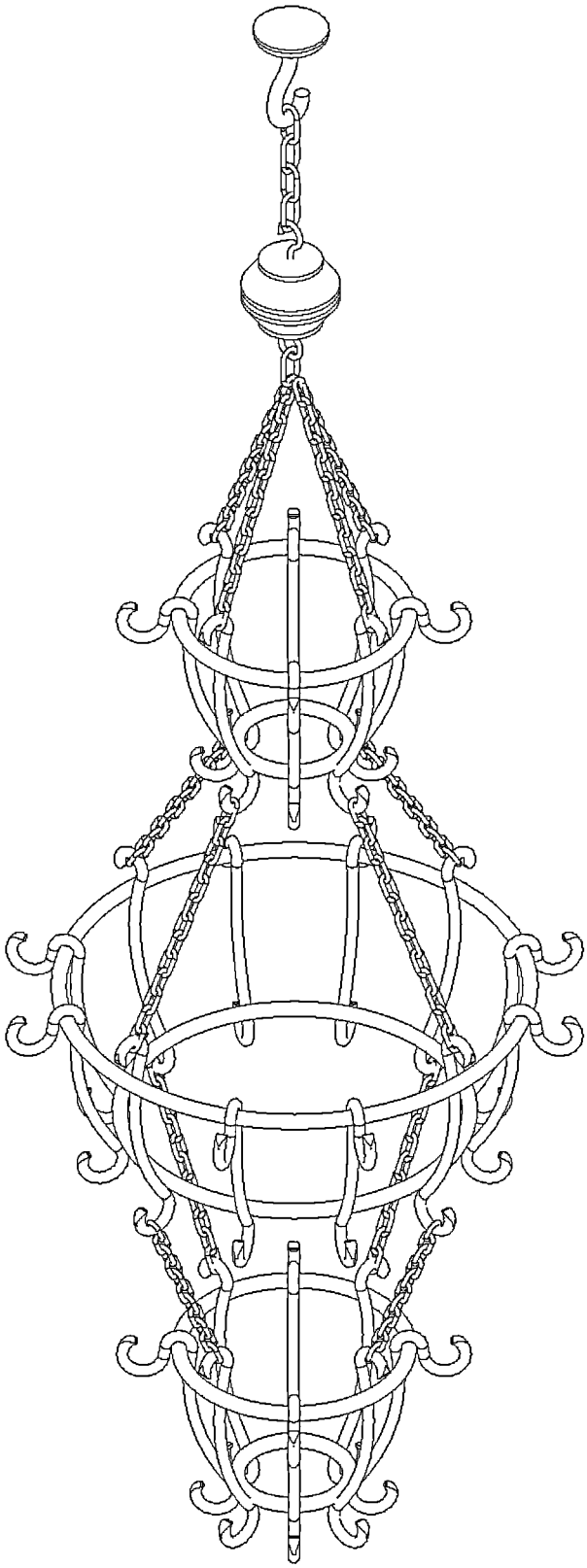
FIG. 6 illustrates an embodiment of a three-tiered rotary organizer and display rack.

FIGS. 5 and 6 illustrate further two-tiered and three-tiered embodiments, respectively, of a rotary organizer and display rack. In these illustrated embodiments, the article support members (e.g., hooks) can be attached to or otherwise integrated with the vertical partitions. Upper rack and lower rack support members can also be attached to or otherwise integrated with the vertical partitions.

Figure 7:
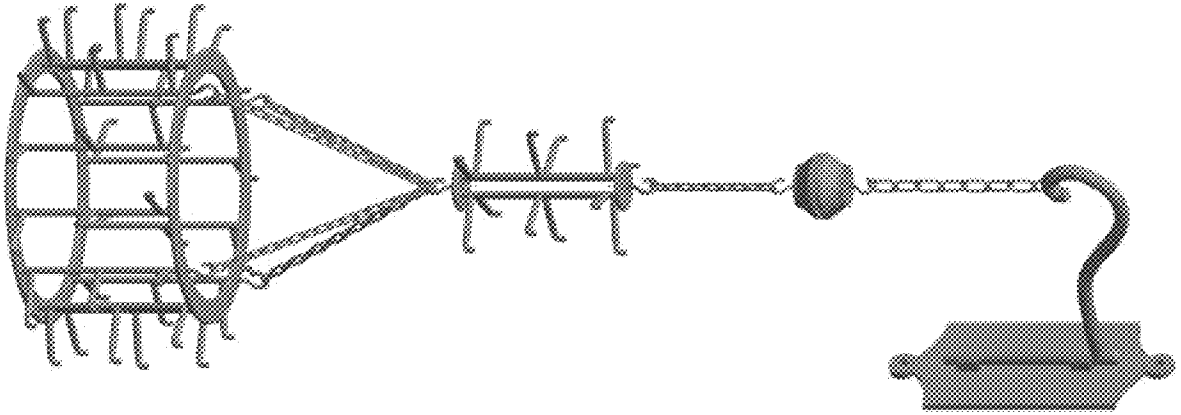
FIG. 7 illustrates an embodiment of a tiered tie rack.

FIG. 7 illustrates a further embodiment of a tiered organizer rack that can be applied to men's ties. In this embodiment, article support members can be attached to or otherwise integrated with the vertical partitions to facilitate hanging of the ties. In one embodiment, one or more vertical partitions can be designed to swivel, thereby enabling swiveling of the article support members.

As has been described, a tiered rotary organizer and display rack can be customized through the addition or removal of one or more tiers. In that regard, elongated hanging supports (e.g., chain, rod, wire, etc.) can be used to connect a lower tier to an upper tier, or from a tier to a support structure. The use of elongated hanging supports between individual tiers facilitates user configurability in applying the organizer and display rack to a particular use. Customization of the tiered rotary organizer can also be enabled through add-on attachments that can support various items to be organized or displayed. These add-on attachments can be in addition to supports that are added to or otherwise integrated with the vertical partitions in a tier of the organizer and display rack.

These and other aspects of the present invention will become apparent to those skilled in the art by a review of the preceding detailed description. Although a number of salient features of the present invention have been described above, the invention is capable of other embodiments and of being practiced and carried out in various ways that would be apparent to one of ordinary skill in the art after reading the disclosed invention, therefore the above description should not be considered to be exclusive of these other embodiments. Also, it is to be understood that the phraseology and terminology employed herein are for the purposes of description and should not be regarded as limiting.

What is claimed is:

1. An organizer rack structure, comprising:

a first organizer rack, including:

a first upper perimeter support;

a first lower perimeter support;

a first plurality of vertical partitions, each of the first plurality of vertical partitions having an upper end and a lower end, each of the first plurality of vertical partitions attached to the first upper perimeter support near the upper end and attached to the first lower perimeter support near the lower end, wherein each of the first plurality of vertical partitions supports an article support member configured to support an item on the first organizer rack;

and a plurality of lower rack support members attached to the first lower perimeter support;

a second organizer rack, including:

a second upper perimeter support;

a second lower perimeter support;

a second plurality of vertical partitions, each of the second plurality of vertical partitions having an upper end and a lower end, each of the second plurality of vertical partitions attached to the second upper perimeter support near the upper end and attached to the second lower perimeter support near the lower end, wherein each of the second plurality of vertical partitions supports an article support member that is configured to support an item on the second organizer rack; and a plurality of upper rack support members attached to the second upper perimeter support; and a plurality of elongated hanging supports, a first end of the plurality of elongated hanging supports coupled to the plurality of lower rack support members of the first organizer rack and a second end of the plurality of elongated hanging supports coupled to the plurality of upper rack support members of the second organizer rack, the plurality of elongated hanging supports providing a hanging support of the second organizer rack below the first organizer rack.

2. The organizer rack structure of claim 1, wherein the first upper perimeter support and the first lower perimeter support are both circular in shape.

3. The organizer rack structure of claim 1, wherein each of the first plurality of vertical partitions are attached to the first upper perimeter support at the upper end and attached to the first lower perimeter support at the lower end.

4. The organizer rack structure of claim 1, wherein each of the first plurality of vertical partitions has an article support member that is configured to support an item on the first organizer rack.

5. The organizer rack structure of claim 4, wherein each of the first plurality of vertical partitions has a plurality of article support members that are configured to support items on the first organizer rack.

6. The organizer rack structure of claim 4, wherein the article support member is configured in a hook shape.

7. The organizer rack structure of claim 4, wherein the article support member is configured to rotate around one of the first plurality of vertical partitions.

8. The organizer rack structure of claim 4, wherein one of the first plurality of vertical partitions has a first hook shaped member located near the upper end and a second hooked shape member located near the lower end.

9. The organizer rack structure of claim 1, further comprising a hook member for support of an article, the hook member configured for removable attachment to one of the first upper perimeter support and the first lower perimeter support.

10. The organizer rack structure of claim 1, wherein the plurality of elongated hanging supports are chains.

11. The organizer rack structure of claim 1, wherein the plurality of elongated hanging supports are rod shaped.

* * * * *